United States Patent [19]

Parsons

[11] Patent Number: 4,955,401

[45] Date of Patent: Sep. 11, 1990

[54] HAIR CURLER

[76] Inventor: Sandra M. Parsons, 4119 NE. 132nd Pl., Portland, Oreg. 97230

[21] Appl. No.: 442,904

[22] Filed: Nov. 29, 1989

[51] Int. Cl.[5] ..... A45D 2/14

[52] U.S. Cl. ..... 132/262; 132/226; 132/245

[58] Field of Search ..... 132/223, 226, 235, 237, 132/242, 245, 246, 247, 250, 253, 254, 262, 264; 223/102, 104

[56] References Cited

U.S. PATENT DOCUMENTS

| | | | |
|---|---|---|---|
| 515,998 | 3/1894 | Deucher | 132/237 |
| 891,573 | 6/1908 | Sulzer | 223/104 |
| 1,377,655 | 5/1921 | Begas | 132/229 |
| 1,424,546 | 8/1922 | Yeager | 132/229 |
| 1,636,967 | 7/1927 | Perry | 132/211 |
| 1,895,653 | 1/1933 | Fisher | 132/268 |
| 1,968,593 | 7/1934 | Baldwin | 132/226 |
| 1,985,472 | 12/1934 | Tubbs | 132/237 |
| 1,994,611 | 3/1935 | Johnson | 132/226 |
| 2,088,272 | 7/1937 | Murphy | 132/226 |
| 2,335,086 | 11/1943 | Ryan | 132/260 |
| 2,721,014 | 10/1955 | Allen | 223/102 |
| 2,783,763 | 3/1957 | King | 132/237 |
| 3,525,460 | 8/1970 | Hendy | 223/102 |
| 3,531,030 | 9/1970 | Doiron | 223/102 |

FOREIGN PATENT DOCUMENTS

| | | | |
|---|---|---|---|
| 205981 | 11/1923 | United Kingdom | 132/245 |
| 562719 | 7/1944 | United Kingdom | 132/245 |

*Primary Examiner*—John J. Wilson
*Assistant Examiner*—Frank A. LaViola, Jr.
*Attorney, Agent, or Firm*—Stoel Rives Boley Jones & Grey

[57] ABSTRACT

A hair curler for use in spiral permanent hair waving includes a rod (32) that has multiple radially projecting cylindrical posts (34*a* and 34*b*) positioned alternately on opposite sides of the rod along its length. The posts along each of the opposite sides are spaced apart uniformly such that a post on one side of the rod is located between next adjacent posts on the opposite side of the rod. An eyelet (56) positioned at a first end (58) of the rod formed by a substantially elliptical loop (60) defined by a major axis (64) that is transverse to the length of the rod. The loop includes a closed end (66) positioned on one side of the rod and a flexible finger (68) positioned at the opposite side of the rod to form an inlet (70) for receiving a base end of a strand of hair. A clip (74) having a pair of flexible fingers (78*a* and 78*b*) is positioned at a second end (76) of the rod for releasably securing to the curler the distal end of the strand of hair.

19 Claims, 1 Drawing Sheet

16
10
18
14a
14b
20
12b
12a
22a
22b 64
62
56
60
68
66
70
38
34a
30
32
34b
88
3
3
34a
34b
42
44
40
76
78a
82
84
80
78b
74
80

42
44
32
92
76
90a
96
96
78a
78b
80
94
80

42
44
32
76
90b
96
96
94

44
40
36
42
32
38

HAIR CURLER

TECHNICAL FIELD

The present invention relates to hair curlers for permanent hair waving and, in particular, to curlers used in spiral-type permanent hair waving.

BACKGROUND OF THE INVENTION

FIG. 1 shows a prior art "chopstick" type curler 10 used in spiral permanent hair waving, which is typically performed by professional hair stylists. Chopstick curler 10 is characterized by a pair of substantially smooth slightly tapered rods 12*a* and 12*b* that are interconnected at their respective narrow ends 14*a* and 14*b* by a flexible circular loop 16.

A base end of a patron's lock or strand of hair is slid between rods 12*a* and 12*b* and past a releasable opening 18 in circular loop 16 formed by ends 14*a* and 14*b*. The strand of hair is then wrapped around a selected one of the rods 12*a* and 12*b* along a spiral path 20 (shown in phantom around rod 12*a*). The strand is nominally held in place by wrapping a rubber band (not shown) under tension around the distal ends 22*a* and 22*b* of respective rods 12*a* and 12*b*. The hair stylist then applies a permanent wave chemical or solution to the strand of hair in a manner known to those skilled in the art.

Although it is commonly available, chopstick curler 10 suffers from at least three major disadvantages. First, chopstick curler 10 is relatively uncomfortable for the patron because circular loop 16 tangentially contacts the patron's head. Since the strand of hair is typically wrapped around the curler relatively tightly, an uncomfortable amount of pressure can be exerted against a relatively small region of the patron's head.

Second, chopstick curler 10 is relatively difficult to use because the hair stylist must pass the patron's strand of hair between rods 12*a* and 12*b* for each revolution of the strand around the selected rod, thereby requiring a great deal of patience or skill on the part of the hair stylist. Finally, the substantially smooth nature of rods 12*a* and 12*b* allows the strand of hair to slide along them even after distal ends 22*a* and 22*b* are secured with a rubber band. Since the appearance of a spiral-type permanent hair wave is dependent upon the pitch of the spiral path of the hair along the curler, slippage of the hair can change the pitch of the spiral path and produce undesired nonuniformities in the appearance of the permanent hair wave.

SUMMARY OF THE INVENTION

An object of the present invention is, therefore, to provide a hair curler for use in spiral-type permanent waving.

Another object of this invention is to provide such a hair curler that is relatively easy for a hair stylist to use.

A further object of this invention is to provide such a hair curler that is relatively comfortable for a patron.

Yet another object of this invention is to provide such a curler about which a strand of hair can be securely wrapped with a selected pitch or variety of pitches.

A preferred embodiment of the hair curler of the present invention includes a single rod along the length of which are multiple radially projecting cylindrical posts positioned alternately on opposite sides of the rod. The posts are of the same length and are spaced-apart uniformly along the length of the rod. An interior post located on one side of the rod bisects the distance between adjacent posts located on the opposite side of the rod. Each post has a free end in the shape of a spherical knob.

An eyelet formed by an elliptical loop is positioned at one end of the rod. The eyelet has a flat major side that is substantially parallel to a major axis of the loop, the major axis being transverse to the length of the rod. The loop includes a closed end positioned on one side of the rod and a flexible finger positioned on the opposite side of the rod, thereby forming an inlet to receive a base end of a strand of hair.

A clip is positioned at the opposite end of the rod from the eyelet for releasably holding the distal end of the strand of hair after it is wrapped around the curler. The clip is formed by a pair of flexible fingers extending along the length of the rod. One of the flexible fingers is substantially smooth and is positioned opposite an undulate side of the other flexible finger.

To use the hair curler, a hair stylist wraps a patron's strand of hair around the rod and between the posts along a selected spiral path. The single rod allows the strand of hair to be wound onto the curler in a relatively easy manner. The posts prevent hair from inadvertently sliding along the length of the rod and thereby allow the strand of hair to be wrapped securely around the curler with a selected pitch or variety of pitches.

The flat major side of the loop distributes over a relatively large area most of the pressure that the curler exerts against the patron's head. In addition, the spherical knobs on the free ends of the posts have relatively large radii of curvature that distribute over correspondingly large areas any pressure exerted by the posts against the patron's head. The curler of the present invention is, therefore, relatively comfortable for the patron.

Additional objects and advantages of the present invention will be apparent from the following detailed description of a preferred embodiment thereof, which proceeds with reference to the accompanying drawings.

DETAILED DESCRIPTION OF PREFERRED EMBODIMENT

Figures 1, 2, 3, 4A, 4B:
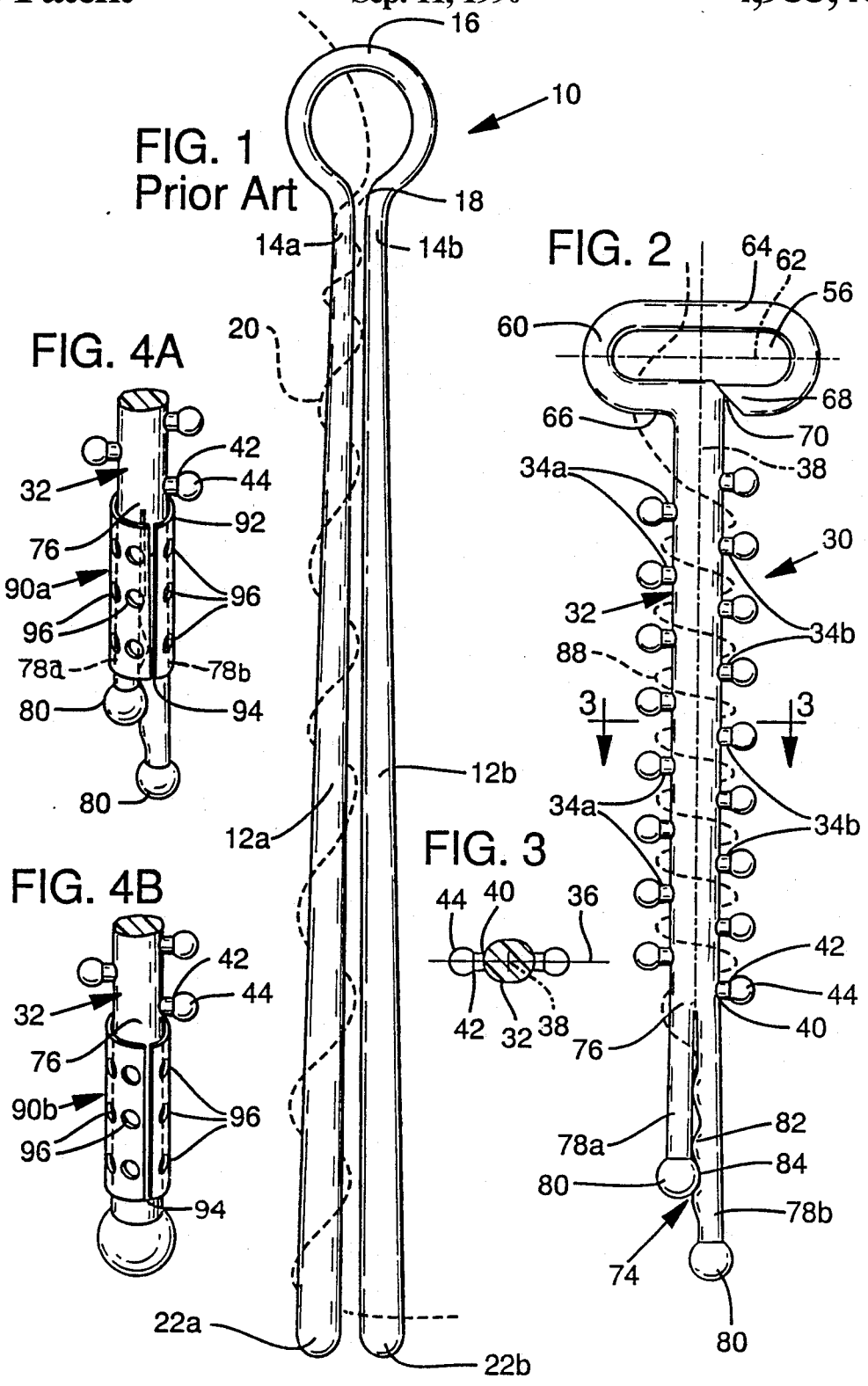
FIG. 1 Prior Art
FIG. 1 is a diagram of a prior art permanent wave curler of the chopstick type.
FIG. 2 is a diagram of a hair curler of the present invention.
FIG. 3 is a sectional view taken along the lines 3—3 in FIG. 2.
FIGS. 4A and 4B are fragmentary diagrams showing alternative clip arrangements compatible with the hair curler of FIG. 2.

FIG. 2 is a diagram of a curler 30 of the present invention used primarily in spiral-type permanent hair waving. Curler 30 includes a single rod 32 that has multiple radially projecting cylindrical posts 34*a* and 34*b* positioned alternately on opposite sides of rod 32 along its length.

Posts 34*a* and 34*b* lie within a common plane 36 (FIG. 3) and are perpendicular to a longitudinal axis 38 that lies within plane 36 and extends along the length of rod 32. Posts 34*a* and 34*b* are of the same length and are spaced-apart uniformly such that an interior post located on one side of the rod is positioned medially of next adjacent posts located on the opposite side of rod 32. In a preferred embodiment, an interior post on one side of rod 32 bisects the distance between next adjacent posts on the opposite side of rod 32.

Each of posts 32*a* and 32*b* includes a base end 40 terminating at rod 32 and a free end 42 in the shape of a spherical knob 44 having a radius greater than that of the post. Rod 32 has a substantially elliptical cross-section (FIG. 3) with a major axis aligned with plane 36.

An eyelet 56 formed by a substantially elliptical loop 60 is positioned at a first end 58 of rod 32. Loop 60 has a major axis 62 that is substantially parallel to a flat major side 64 located on a side of loop 60 opposite rod 32. Major axis 62 of loop 60 is substantially perpendicular to longitudinal axis 38 and lies within plane 36. Loop 60 preferably has a circular cross-section in a plane parallel to axis 38 and perpendicular to the plane of FIG. 2, and includes a closed end 66 that is positioned on one side of rod 32. A flexible finger 68 is positioned on an opposite side of rod 32 and forms an inlet 70 through which a base end of a patron's strand of hair (not shown) is passed into eyelet 56.

A clip 74 is positioned at a second end 76 of rod 32 for releasably securing to curler 30 a distal end of the strand of hair after it has been wrapped around the curler. Clip 74 includes a pair of flexible fingers 78*a* and 78*b* that extend along the length of rod 32 and have knobs 80 on their free ends. Flexible finger 78*a* is substantially smooth and is positioned opposite an undulate side 82 of flexible finger 78*b*. Knob 80 on flexible finger 78 is aligned with a recess 84 in undulate side 82 to releasably close the free end of clip 74.

To use curler 30, a hair stylist passes the base end of a patron's lock or strand of hair past flexible finger 68, through inlet 70, and into eyelet 56. The strand of hair is then wrapped around rod 32 and between posts 34*a* and 34*b* along a selected spiral path 88. It will be appreciated that spiral path 88 shown in FIG. 2 is one of many possible spiral paths that may be formed along curler 30. For example, spiral paths of different fixed or varying pitches can be formed by wrapping the strand of hair around selected ones of posts 34*a* and 34*b*. As a result, curler 30 provides a great deal of versatility in controllably varying the appearance of a spiral permanent wave.

The strand of hair is typically wrapped around curler 30 relatively tightly, which can cause it to exert a noticeable amount of pressure against the patron's head. Flat major side 64 of loop 60 distributes this pressure over a relatively large area on the patron's head, thereby making curler 30 relatively comfortable for the patron. Similarly, knobs 44 and 80 distribute over relatively large areas pressure exerted by posts 34*a* and 34*b* and flexible fingers 78*a* and 78*b* against the patron's head.

Curler 30 is preferably manufactured as an integral, molded plastic device that is substantially rigid but sufficiently resilient to accommodate the releasable action of flexible fingers 68, 78*a*, and 78*b*. A set of curlers 30 for spiral-type permanent hair waving would typically include, for example, about thirty curlers in each of three sizes to accommodate different lengths of hair or to vary the appearance of a spiral permanent wave. Curlers of different sizes would typically have rods of different lengths, different diameters, and different numbers of, or spacings between, the posts. A typical spiral-type permanent wave would employ approximately twenty-four curlers.

FIGS. 4A and 4B show alternative clips 90*a* and 90*b*, respectively, that each employs an elongated removable tubular cuff 92 that encircles second end 76 of rod 32. Cuff 92 includes a split 94 along its length and is sufficiently resilient that rod 32 can be passed through split 94. In addition, cuff 92 includes multiple spaced-apart perforations 96.

Cuff 92 holds the extreme distal end of a strand of hair against the curler, thereby allowing the permanent wave to extend to the extreme distal end. Without cuff 92, the extreme distal end of a strand of hair sometimes hangs free of the curler and must be cut away because it would not be curled by the permanent wave. Such trimming of a patron's hair is undesireable if the hair is already of a desired length. Perforations 94 allow the permanent wave chemical or solution to pass through cuff 92 to the extreme distal end of the strand of hair.

In FIG. 4A, clip 90*a* includes an opposed pair of flexible fingers 78*a* and 78*b* that are encircled by cuff 92. Flexible fingers 78*a* and 78*b* cooperate with cuff 92 to hold the strand of hair to the curler and to wrap the extreme distal end of the strand around the curler. In FIG. 4B, end 76 of rod 32 is in the shape of a single substantially smooth rod that is encircled by cuff 92. In clip 90*b*, cuff 92 alone holds the strand of hair to end 76 of rod 32 and wraps the extreme distal end of the strand around the curler.

It will be obvious to those having skill in the art that many changes may be made to the details of the above-described preferred embodiment of the present invention without departing from the underlying principles thereof. For example, knobs 44 on posts 34*a* and 34*b* could be of hemispherical shape that is defined by a radius that is substantially the same as that of the posts. The scope of the present invention should, therefore, be determined only by the following claims.

I claim:

1. A hair curler, comprising:

a rod having first and second ends and a length along which plural radially projecting cylindrical posts of uniform length are positioned alternately on opposite sides of the rod, the posts along each of the opposite sides of the being spaced apart by a uniform distance such that a post on one side of the rod bisects the rod distance between an adjacent pair of posts on the opposite side of the rod;

an eyelet positioned at the first end of the rod and formed by a substantially elliptical loop defined by a major axis that is substantially perpendicular to the length of the rod, the loop being closed on one side of the rod and having a flexible finger on an opposite side of the rod to form an inlet for receiving a base end of a strand of hair to be wrapped around the curler; and clip means positioned at the second end of the rod for securing to the curler a distal end of the strand of hair, the clip means including second and third opposed flexible fingers that extend along the longitudinal axis.

2. The curler of claim 1 in which the posts and the major axis of the loop lie in a common plane.

3. The curler of claim 1 in which the rod has an elliptical cross-section.

4. The curler of claim 3 in which the elliptical cross-section of the rod is defined by a major axis with which the posts are aligned.

5. The curler of claim 1 in which each post has a base end terminating at the rod and a free end at which a knob is positioned.

6. The curler of claim 1 in which the loop includes a flat major side that is parallel to the major axis and is positioned on a side of the loop opposite the rod.

7. The curler of claim 1 in which the third flexible finger has an undulate surface and the second flexible finger is substantially smooth and is positioned opposite the undulate surface of the third flexible finger.

8. The curler of claim 1 in which the clip means includes a removable tubular cuff that encircles the second and third flexible fingers.

9. The curler of claim 8 in which the cuff includes multiple perforations.

10. A hair curler, comprising:

a rod having first and second ends and a length from which plural posts transversely project alternately on opposite sides of the rod, the posts along each of the opposite sides of the rod being spaced such that a post on one side of the rod is located between an adjacent pair of posts on the other side of the rod;

an eyelet formed by a loop that is positioned at the first end of the rod, is closed on one side of the rod, and includes a first flexible finger on another side of the rod to form an inlet for receiving a base end of a strand of hair to be wrapped around the curler, the loop forming the eyelet being of substantially elliptical shape that is defined by a major axis that is transverse to the length of the rod.

11. The curler of claim 10 in which the loop includes a flat major side that is substantially parallel to the major axis and is positioned on a side of the loop opposite the rod.

12. A hair curler, comprising:

a rod having first and second ends and a length from which plural posts transversely project alternately on opposite sides of the rod, the posts along each of the opposite sides of the rod being spaced such that a post on one side of the rod is located between an adjacent pair of posts on the other side of the rod;

an eyelet formed by a loop that is positioned at the first end of the rod, is closed on one side of the rod, and includes a first flexible finger on another side of the rod to form an inlet for receiving a base end of a strand of hair to be wrapped around the curler; and clip means positioned at the second end of the rod for securing to the curler a distal end of the strand of hair.

13. The curler of claim 12 in which the clip means includes second and third flexible fingers that extend along the longitudinal axis, the third flexible finger having an undulate surface and the second flexible finger being substantially smooth and positioned opposite the undulate surface of the third flexible finger.

14. The curler of claim 13 in which the clip means includes a removable tubular cuff that encircles the second and third flexible fingers.

15. The curler of claim 12 in which the clip means includes a removable tubular cuff that encircles the second end of the rod.

16. The curler of claim 12 in which the loop and the posts lie in a common plane.

17. The curler of claim 12 in which the rod has an elliptical cross section.

18. The curler of claim 12 in which the elliptical cross section of the rod is defined by a major axis with which the posts are aligned.

19. The curler of claim 12 in which each post has a base end terminating at the rod and a free end at which a knob is positioned.

* * * * *